United States Patent [19]

Greeott

[11] 4,169,557

[45] Oct. 2, 1979

[54] INVERTIBLE GARDEN SPRINKLER

[76] Inventor: George S. Greeott, 9605 Chalk Hill Rd., Healdsburg, Calif. 95448

[21] Appl. No.: 865,325

[22] Filed: Dec. 28, 1977

[51] Int. Cl.[2] ..... B05B 1/16

[52] U.S. Cl. ..... 239/443; 239/393

[58] Field of Search ..... 239/392, 393, 394, 443–449

[56] References Cited

U.S. PATENT DOCUMENTS

| | | | |
|---|---|---|---|
| 1,166,374 | 12/1915 | Jackson | 239/442 |
| 2,722,457 | 11/1955 | Livingston | 239/447 |
| 3,385,525 | 5/1968 | Jacobs | 239/394 |

*Primary Examiner*—Robert W. Saifer

*Attorney, Agent, or Firm*—Clarence A. O'Brien; Harvey B. Jacobson

[57] ABSTRACT

A body is provided and supported from a base for oscillation relative thereto about a generally horizontal axis. The body is hollow and includes a tubular inlet neck opening outwardly from the interior thereof along a path at least closely adjacent and paralleling the axis of oscillation of the body. The outer end of the neck is adapted to have the discharge end of the water supply line coupled thereto and the body defines an elongated interior compartment into which the inlet neck opens. The compartment includes opposite end portions disposed on opposite sides of the inlet neck and each of the opposite end portions includes a valve seat facing toward the inlet neck. A gravity valve member is mounted in the body for gravity movement therein between positions in seated engagement with the seats and the body is oscillatable relative to the base between positions with the remote ends of the opposite end portions of the interior compartment disposed lowermost. The body further includes a pair of different spray-patterned sprinkler heads supported therefrom into which the opposite end portions of the cavity open and disposed downstream from the corresponding seats.

5 Claims, 6 Drawing Figures

INVERTIBLE GARDEN SPRINKLER

BACKGROUND OF THE INVENTION

There are many instances in which a person desires to alternately position a lawn or garden sprinkler in different locations in which it is desirable for the sprinkler to discharge different spray patterns of water therefrom. In these instances a person wishing to water a lawn or garden must successively utilize different sprinklers for the most advantageous application of water to the lawn or garden with a minimum amount of water wasted. Inasmuch as water, particularly in the summer months, is becoming scarce, a need exists whereby a relatively inexpensive garden or lawn sprinkler may be provided with means to selectively discharge different spray patterns of water therefrom.

Examples of the various forms of lawn and garden sprinklers including some of the general structural and operational features of the instant invention and which are operative to selectively discharge different spray patterns of water therefrom are disclosed in U.S. Pat. Nos. 1,544,521, 2,711,925, 3,081,950 and 3,385,525.

BRIEF DESCRIPTION OF THE INVENTION

The sprinkler of the instant invention a pair of remote sprinkler heads interconnected by means of a central elongated compartment within the body of the sprinkler and the sprinkler is mounted for rotation relative to a support base therefor in a manner such that the sprinkler heads may be alternatively disposed uppermost. In addition, the sprinkler includes an inlet neck which opens into the interior cavity or compartment of the body of the sprinkler and to which the outlet end of a water supply hose may be operably connected. Further, the interior of the sprinkler body includes a pair of valve seats upstream from the heads and downstream from the inlet neck and a valve member is shiftably supported within the body for gravity movement between positions in seated engagement with the seats. Accordingly, when one head of the body is disposed lowermost and the other head of the body is disposed uppermost, the valve member falls by gravity into seated engagement with the vavle seat controlling the flow of water from the inlet neck to the lowermost head. Accordingly, water supplied to the sprinkler head through the inlet neck thereof is discharged only from the uppermost sprinkler head. Of course, when the body is inverted and the previously lowermost head is disposed uppermost, the valve member falls by gravity into seated engagement with the seat controlling the flow of water to the previously uppermost head (now disposed lowermost). In this manner, the sprinkler of the instant invention may have the body thereof readily inverted in order to discharge a different spray pattern of water.

The main object of this invention is to provide a garden or lawn sprinkler which will be capable of selectively discharging different spray patterns of water therefrom.

Another object of this invention is to provide a sprinkler construction in accordance with the preceding object and including at least two different spray heads which may be alternately positioned uppermost for discharging a corresponding spray pattern of water from the sprinkler.

Another important object of this invention is to provide a sprinkler which may be readily equipped with a variety of different spray heads.

A final object of this invention to be specifically enumerated herein is to provide a lawn or garden sprinkler in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part thereof, wherein like numerals refer to like parts throughout.

DETAILED DESCRIPTION OF THE INVENTION

Figure 4:
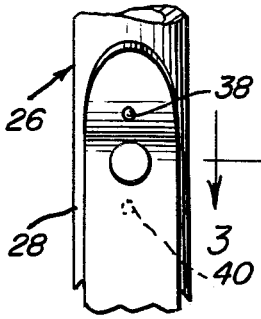
FIG. 4 is a fragmentary, vertical sectional view taken substantially upon the plane indicated by the section line 4—4 of FIG. 1.

Referring now more specifically to the drawings, the numeral 10 generally designates a first form of sprinkler constructed in accordance with the present invention. The sprinkler 10 includes a base assembly referred to in general by the reference numeral 12, and the base assembly includes a base plate 14 including opposite side upwardly convergent spring-type support arms 16 and 18. The upper end of the support arm 16 is vertically disposed and includes a cylindrical horizontal opening 20 formed therethrough. The upper end portion of the support arm 18 includes a substantially vertical portion 22 and the vertical portion 22 has a horizontal cylindrical opening 24 formed therein of somewhat smaller diameter than the opening 20.

The sprinkler 10 further includes a body referred to in general by the reference numeral 26 and the body 26 comprising an elongated tubular member 28 defining an elongated generally cylindrical compartment 30 therein. The tubular member 28 includes an integral tubular inlet neck 32 which opens into the longitudinal mid-portion of the compartment 30 and the outer end of the inlet neck 32 includes an integral internally threaded female coupling 34 into which the externally male end of a conventional garden hose may be threadedly secured.

The side of the tubular member 28 remote from the inlet neck 32 includes an outwardly projecting cylindrical support stud 36 axially aligned with the inlet neck 32 and the inlet neck 32 is rotatably received through the opening 20 and the stud 36 is rotatably received through the opening 24. In addition, the support arm 18 includes a small aperture 38 formed therein above the opening 24 and a small detent recess 40 formed within, on the side thereof opposing the support arm 16, spaced below the opening 24.

The portions of the support arm 16 and 18 through which the openings 20 and 22 are formed compressively engage the opposing opposite sides of the tubular member 28 of the body 26 therebetween and the tubular member 28 includes detent projections 42 above and below the support stud 36. The detent projections 42 are selectively engageable in the aperture 38 and the recess 40 whereby the opposite ends of the tubular member 28 may be alternately disposed uppermost.

The opposite ends of the tubular member 28 include annular seats 44 and 46 which open toward the longitudinal mid-portion of the tubular member 28 and a spherical valve member 48 is freely received within the tubular member 28 for gravity movement between positions seated against the seats 44 and 46. The end of the tubular member 28 adjacent seat 44 has a square pattern, hollow sprinkler head 50 supported therefrom and the end of the tubular member 28 adjacent the seat 46 has a hollow round pattern sprinkler head 52 supported therefrom. The seats 44 and 46 open directly into the heads 50 and 52 and the heads 50 and 52 include outlet openings 54 and 56, respectively, therein through which water may be discharged from the heads 50 and 52 in square and round spray patterns, respectively.

Figure 1:
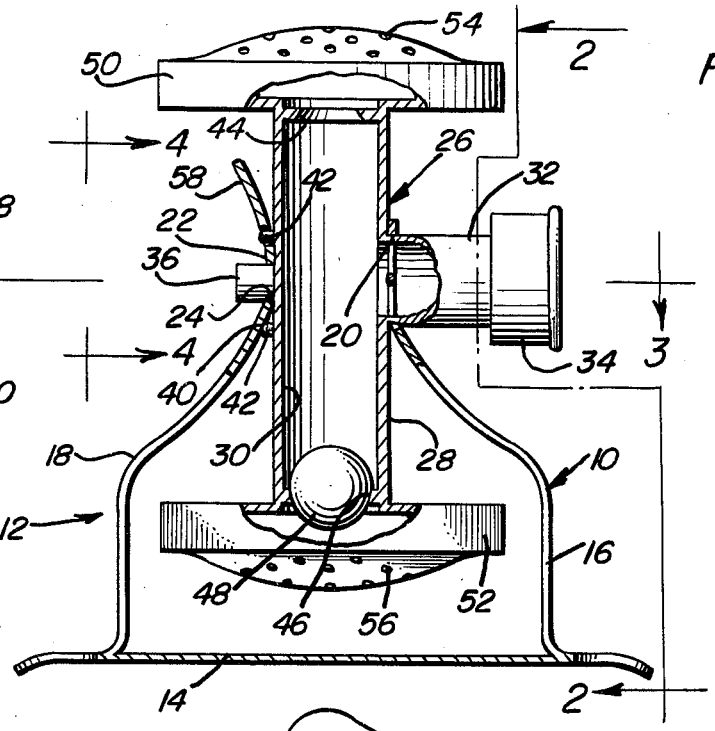
FIG. 1 is a side elevational view of the sprinkler of the instant invention with portions thereof being broken away and illustrated in vertical sections.

In operation, the outlet end of the garden hose may be operably connected to the female coupling 34 and when the body 26 is in the position thereof illustrated in FIG. 1 of the drawings, the valve member 48 will fall by gravity into seated engagement with the seat 46 and all of the water admitted into the compartment 30 through the inlet neck 32 will be discharged from the openings or apertures 54 of the spray head 50. On the other hand, if the upper end portion 58 of the support arm 18 is displaced outwardly from the tubular member 28, the detent projections 42 will be unseated from the aperture 38 and the recess 40 and the body 26 may thereafter be rotated 180 degrees relative to the body assembly 12 whereby the head 52 will be disposed uppermost and the head 50 will be disposed lowermost. In this position, the valve member 48 falls by gravity into seated engagement with the seat 44 and all of the water admitted into the compartment 30 through the inlet neck 32 is discharged from the openings 56 of the head 52.

Figure 2:
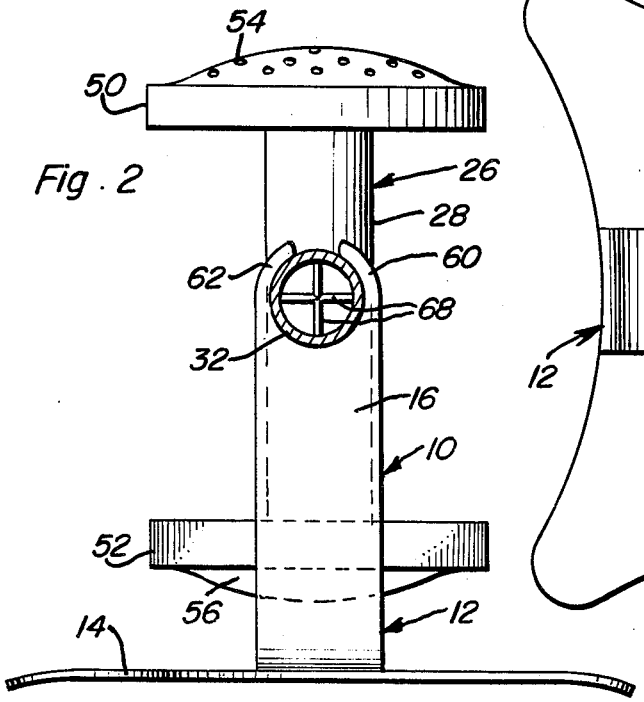
FIG. 2 is a vertical sectional view taken substantially upon the plane indicated by the section line 2—2 of FIG. 1.
Figure 3:
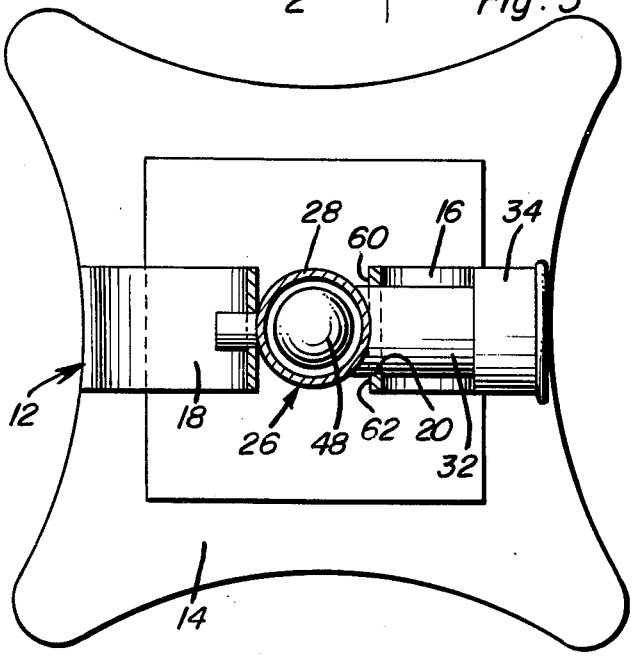
FIG. 3 is a horizontal sectional view taken substantially upon the plane indicated by the section line 3—3 of FIG. 1.

The opening 20 is defined by a pair of opposite side arms 60 and 62 which are initially disposed in parallel relation before assembly of the body 26 to the base assembly 12. When the arms 60 and 62 are in parallel relation, they define an upwardly opening U-shaped recess therebetween into which the inlet neck 32 is readily receivable. After the body 26 has been assembled to the base assembly 12, the upper ends of the arms 60 and 62 are bent into the arcuate configurations thereof illustrated in FIG. 2 whereby the body 26 is permanently mounted to the base assembly 12.

Figure 5:
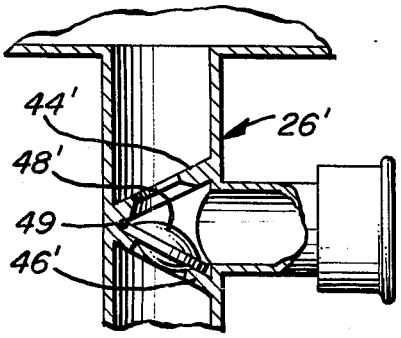
FIG. 5 is a fragmentary, vertical sectional view illustrating a modified form of sprinkler.

With reference now more specifically to FIG. 5 of the drawings, there will be seen a modified form of body referred to in general by the reference numeral 26'. The body 26' is generally similar to the body 26, but includes modified oppositely angled seats 44' and 46' in lieu of the seats 44 and 46. In addition, the body 26 includes a pivoted flap valve member 48' instead of a spherical valve member such as the valve member 48, and it is believed that it may be readily seen that the valve member 48' may readily swing back and forth between positions in seated engagement with the seats 44' and 46', the flap valve member 48' being pivotally supported from the body 26' as at 49.

Figure 6:
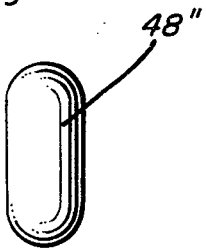
FIG. 6 is a side elevational view illustrating a modified form of valve member which may be utilized in conjunction with the sprinkler illustrated in FIG. 1.

With reference now more specifically to FIG. 6 of the drawings, there may be seen a modified form of valve member 48'' which may be used in the body 26 in lieu of the valve member 48. The valve member 28'' comprises an elongated cylindrical valve member including hemispherical opposite ends and it is believed obvious that the valve member 48 may also be loosely received within the compartment 30 for shifting longitudinally thereof into positions with the opposite ends of the valve member 48' in seated engagement with the seats 40 and 46.

In that form of the invention illustrated in FIGS. 1–4, the innermost end of the inlet neck 32 includes internal crossed transverse bars 68 to prevent movement of the valve member 48 into the inlet neck 32.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sprinkler construction including a base, a body supported from said base for oscillation relative thereto about a generally horizontal axis, said body being hollow and including tubular inlet neck opening outwardly from the interior thereof along a path at least closely adjacent and paralleling said axis, the outer end of said neck being adapted to have the discharge end of a water supply line coupled thereto, said body defining an elongated interior compartment into which said neck opens and including opposite end portions disposed on opposite sides of said inlet neck, each of said opposite end portions including means defining a valve seat facing toward said inlet neck, a gravity valve member mounted in said body for gravity movement therein between positions in seated engagement with said seats, said body being oscillatable relative to said base between positions with the remote ends of said opposite end portions alternately lowermost, said body further including a pair of different spray pattern sprinkler heads supported therefrom into which said opposite end portions open and disposed downstream from the corresponding seats, said base including means defining a horizontal aperture and an upwardly opening notch spaced horizontally from and aligned with said aperture, said body including an outwardly projecting stud rotatably received in said aperture and on the side of said body remote from said inlet neck, said inlet neck being cradled in said notch for rotation therein, the upper end of said notch being defined between a pair of generally parallel arm portions of said body whose upper ends are curved toward each other over upper opposite side portions of said neck for retaining the latter in said notch.

2. The combination of claim 1 wherein said valve member comprises a spherical valve member freely movable through said compartment between said seats.

3. The combination of claim 1 wherein said valve member comprises a freely gravity shiftable elongated body having opposite end faces defining valve heads sealingly engageable with said seats.

4. A sprinkler construction including a base, a body supported from said base for oscillation relative thereto about a generally horizontal axis, said body being hollow and including tubular inlet neck opening outwardly from the interior thereof along a path at least closely adjacent and paralleling said axis, the outer end of said neck being adapted to have the discharge end of a water supply line coupled thereto, said body defining an elongated interior compartment into which said neck opens and including opposite end portions disposed on opposite sides of said inlet neck, each of said opposite end portions including means defining a valve seat facing toward said inlet neck, a gravity valve member mounted in said body for gravity movement therein between positions in seated engagement with said seats, said body being oscillatable relative to said base between positions with the remote ends of said opposite end portions alternately lowermost, said body further including a pair of different spray pattern sprinkler heads supported therefrom into which said opposite end portions open and disposed downstream from the corresponding seats, said elongated interior compartment being substantially longitudinally straight and said neck opens into a longitudinal mid-portion thereof, said seats being oppositely inclined relative to said path and said valve member comprises a pivoted valve member freely swingable to opposite sides of said path into engagement with said seats.

5. A sprinkler construction including a base, a body supported from said base for oscillation relative thereto about a generally horizontal axis, said body being hollow and including tubular inlet neck opening outwardly from the interior thereof along a path at least closely adjacent and paralleling said axis, the outer end of said neck being adapted to have the discharge end of a water supply line coupled thereto, said body defining an interior compartment having remote outlets disposed on opposite sides of said axis, each of said outlets including a spray head operatively associated therewith, a valve member gravity shiftable in said compartment, said body including seat means for controlling the flow of water from said inlet neck through said compartment and to said spray heads, said valve member including portions thereof, upon gravity shifting of said valve member, sealingly engageable with the seat controlling the flow of water to the lowermost head to terminate the flow of water thereto upon rotation of said body relative to said base with that spray head lowermost, said valve member comprising a flap-type valve member swingably supported within said compartment from said body for swinging gravity movement between positions seated against said seats.

* * * * *